US010364653B2

(12) United States Patent
Xu et al.

(10) Patent No.: US 10,364,653 B2
(45) Date of Patent: Jul. 30, 2019

(54) ACTUATION TOOL HAVING A NON-BALLISTIC FORCE GENERATING MECHANISM

(71) Applicants: YingQing Xu, Tomball, TX (US); Zhiyue Xu, Cypress, TX (US); Zhihui Zhang, Katy, TX (US); Lei Zhao, Houston, TX (US)

(72) Inventors: YingQing Xu, Tomball, TX (US); Zhiyue Xu, Cypress, TX (US); Zhihui Zhang, Katy, TX (US); Lei Zhao, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 253 days.

(21) Appl. No.: 15/337,532

(22) Filed: Oct. 28, 2016

(65) Prior Publication Data

US 2018/0119520 A1 May 3, 2018

(51) Int. Cl.
*E21B 41/00* (2006.01)
*E21B 4/00* (2006.01)

(52) U.S. Cl.
CPC ..... *E21B 41/00* (2013.01); *E21B 4/00* (2013.01)

(58) Field of Classification Search
CPC ..... E21B 41/00; E21B 4/00; E21B 33/128; E21B 33/13; E21B 33/134; E21B 33/1298
See application file for complete search history.

(56) References Cited

U.S. PATENT DOCUMENTS 6,179,055 B1 1/2001 Sallwasser et al.
8,322,426 B2 * 12/2012 Wright ..... E21B 34/063 166/317
8,839,871 B2 * 9/2014 Wright ..... E21B 23/04 166/383
2007/0029078 A1 * 2/2007 Wright ..... E21B 34/10 166/72
2008/0017389 A1 * 1/2008 Murray ..... E21B 23/04 166/383
2008/0047715 A1 2/2008 Moore
2010/0175871 A1 * 7/2010 Wright ..... E21B 23/04 166/244.1
2011/0174504 A1 7/2011 Wright et al.
2015/0034339 A1 * 2/2015 Jurgensmeier ..... E21B 33/128 166/387
2015/0315871 A1 * 11/2015 Fripp ..... E21B 23/06 166/374
2015/0322747 A1 * 11/2015 Kasperski ..... E21B 34/063 166/373
2016/0258245 A1 * 9/2016 Eldho ..... E21B 33/12

FOREIGN PATENT DOCUMENTS

WO 2016137465 A1 9/2016

OTHER PUBLICATIONS

International Search Report/Written Opinion Application No. PCT/US2017/053994, dated Jan. 5, 2018, 12 pages.

* cited by examiner

*Primary Examiner* — Michael R Wills, III
(74) *Attorney, Agent, or Firm* — Cantor Colburn LLP

(57) ABSTRACT

A non-ballistic force generating mechanism includes a non-ballistic first actuator operable to output a first force profile defining a first pressure for a first stroke length, and a non-ballistic second actuator operable to output a second force profile following the first force profile, the second force profile defining an second pressure that is substantially (Continued)

greater than the first pressure for a second stroke length that is less than the first stroke length.

23 Claims, 5 Drawing Sheets

ACTUATION TOOL HAVING A NON-BALLISTIC FORCE GENERATING MECHANISM

BACKGROUND

Resource exploration and recovery system employ a string of tubulars that extends into a borehole. The string of tubulars may include various elements that facilitate resource recovery, testing, or other operations performed in or on a formation. For example, the string of tubulars may include various elements such as packers, valves, slips and the like. The various elements may be manipulated to promote various downhole operations including isolating portions of a formation, promoting fluid passage, and/or fixedly positioning components. An actuation tool may be employed to manipulate one or more elements.

The actuation tool may rely on an application of pressure provided from the surface to manipulate the element. In certain cases, it is desirable to apply a high energy force to the element that cannot be achieved through the application of pressure from the surface. In such cases, a ballistic actuator may be employed. The ballistic actuator may rely on a rapid, thermal expansion of an accelerant to provide the high energy force.

SUMMARY

A non-ballistic force generating mechanism includes a non-ballistic first actuator operable to output a first force profile defining a first pressure for a first stroke length, and a non-ballistic second actuator operable to output a second force profile following the first force profile, the second force profile defining an second pressure that is substantially greater than the first pressure for a second stroke length that is less than the first stroke length.

A resource exploration and recovery system including a surface system, a downhole system including a plurality of tubulars and at least one actuatable device, and an actuation tool having a non-ballistic force generating mechanism extending through one or more of the plurality of tubulars toward the at least one actuatable device. The non-ballistic force generating mechanism including a non-ballistic first actuator operable to output a first force profile to the at least one actuatable device, the first force profile defining a first pressure for a first stroke length, and a non-ballistic second actuator operable to output a second force profile to the at least one actuatable device following the first force profile. The second force profile defines a second pressure that is substantially greater than the first pressure for a second stroke length that is less than the first stroke length.

A method of actuating a downhole device includes activating a non-ballistic first actuator to deliver a first activation pressure having a first force defined by a first force profile to the downhole device, and activating a non-ballistic second actuator to deliver a second activation pressure having a second force profile including an second force, that is substantially greater than the first force, to the downhole device.

BRIEF DESCRIPTION OF THE DRAWINGS

Referring now to the drawings wherein like elements are numbered alike in the several Figures.

DETAILED DESCRIPTION

Figure 1:
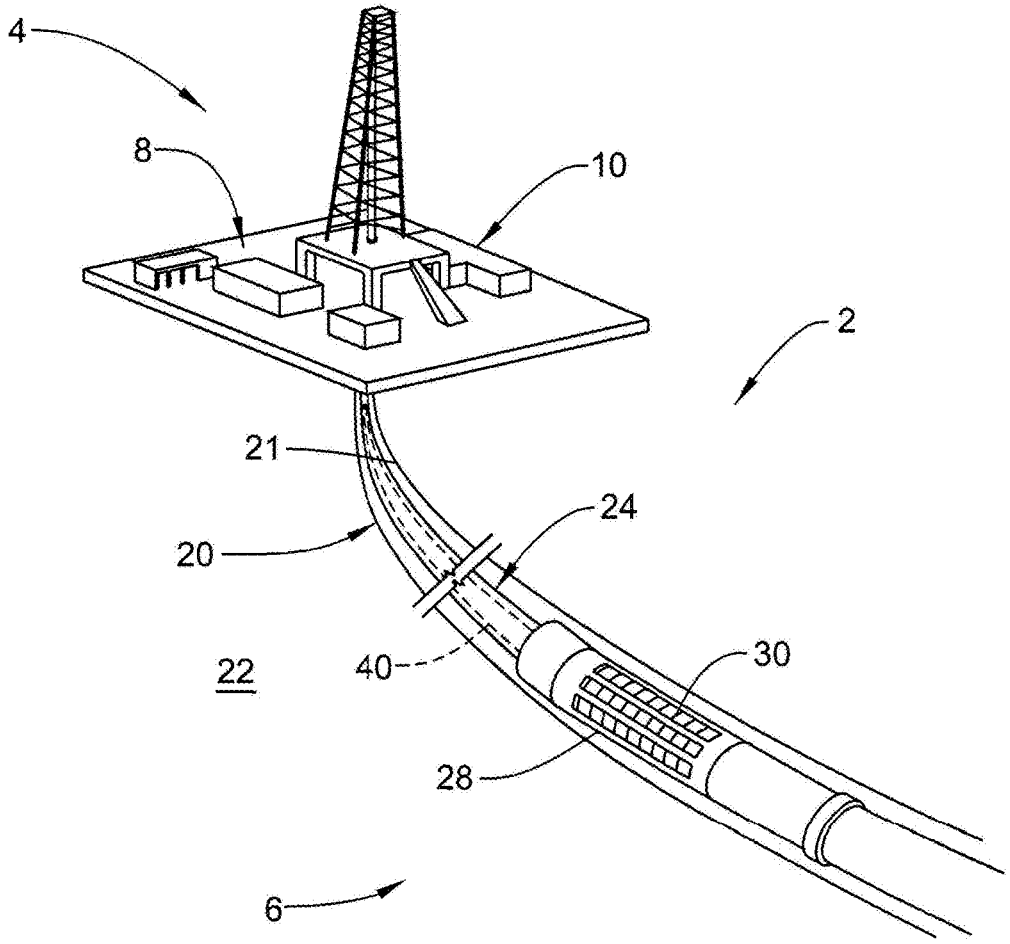
FIG. 1 depicts a resource extraction and exploration system including a actuation tool having a non-ballistic force generating mechanism, in accordance with an aspect of an exemplary embodiment.

A resource exploration and/or recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a surface system 4 operatively connected to a downhole system 6. Surface system 4 may include pumps 8 that aid in completion and/or extraction processes as well as fluid storage 10. Fluid storage 10 may contain a gravel pack fluid or slurry (not shown) that is introduced into downhole system 6.

Downhole system 6 may include a system of tubulars 20 that are extended into a borehole 21 formed in formation 22. System of tubulars 20 may be formed from a number of connected downhole tools or tubulars 24. One of tubulars 24 may be operatively connected to an actuatable device such as a slip assembly 28 having one or more slip members 30. In accordance with an exemplary embodiment, slip assembly 28 may be deployed by an actuation tool 40 having a non-ballistic force generating mechanism 44. Actuation tool 40 may be sent from surface system 4 downhole to slip assembly 28. Once in place, non-ballistic force generating mechanism 44 may be selectively activated to initiate a multi-stage actuation process causing slip members 30 to extend outwardly to engage with borehole 21. It is to be understood that non-ballistic force generating mechanism may be employed to actuate a wide array of devices including packers, bridge plugs, frac plugs and the like or may be utilized to pull free an object that may be stuck downhole.

Figure 2:
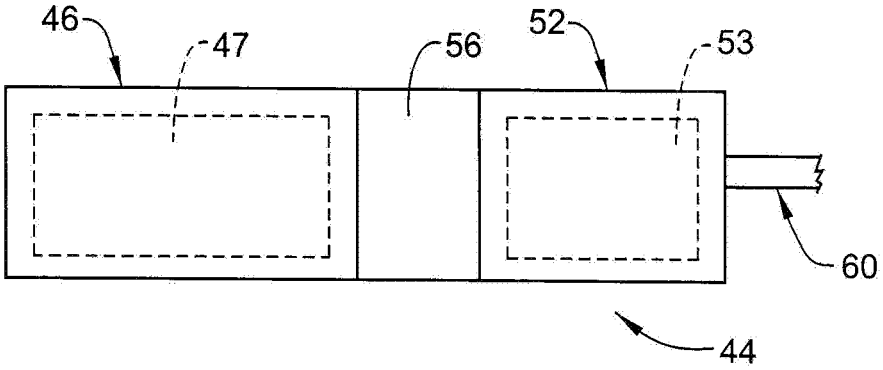
FIG. 2 is a block diagram illustrating the non-ballistic force generating mechanism, in accordance with an aspect of an exemplary embodiment'
Figure 3:
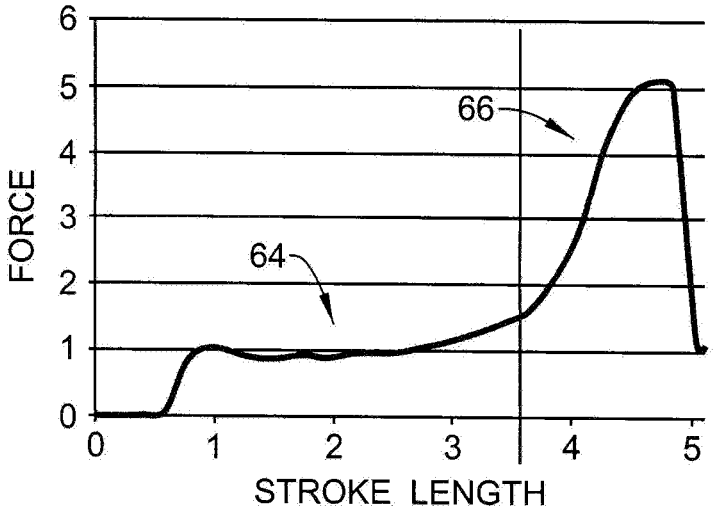
FIG. 3 is a graph depicting first and second force profiles generated by the non-ballistic force generating mechanism, in accordance with an aspect of an exemplary embodiment.

In accordance with an aspect of an exemplary embodiment illustrated in FIG. 2, non-ballistic force generating mechanism 44 may include a first module 46 having a non-ballistic first actuator 47 and a second module 52 having a non-ballistic second actuator 53. First module 46 may be operatively connected to second module 52 through a body lock ring (BLR) 56. Non-ballistic force generating mechanism 44 may also include an actuation element 60 that interfaces with slip assembly 28 to selectively deploy slip members 30. Non-ballistic first actuator 47 is operable to deliver a first activation pressure having a first force profile 64 depicted in FIG. 3, and non-ballistic second actuator 53 is operable to deliver a second activation pressure having a second pressure profile 66. First force profile 64 defines a first pressure that is output for a first stroke length. The first pressure, as shown in FIG. 3, may be substantially constant. More specifically, non-ballistic first actuator 47 delivers a low activating pressure over a long travel distance or stroke length (as compared to non-ballistic second actuator 53) to shift slip members 30 outward into contact with a borehole or casing surface.

Figure 4:
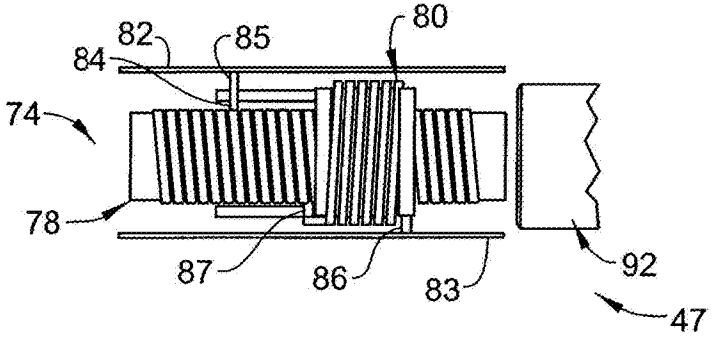
FIG. 4 depicts a non-ballistic first actuator of the non-ballistic force generating mechanism, in accordance with an aspect of an exemplary embodiment.

In accordance with an aspect of an exemplary embodiment depicted in FIG. 4, non-ballistic first actuator 47 takes the form of an electromagnetic launcher 74 including a stator 78 and an armature 80. Electromagnetic launcher 74 also includes a first power supply rail 82 and a second power supply rail 83. First power supply rail 82 is electrically coupled to stator 78 through a first brush 84 and a second brush 85. Second power supply rail 83 is electrically connected to armature 80 through a third brush 86. A fourth brush 87 electrically connects stator 78 to second power supply rail 83 through armature 80. A first activation element 92 may be coupled to armature 80 and slip assembly 28.

In accordance with an exemplary aspect, actuation tool 40 is positioned downhole at slip assembly 28. Once in position, a signal is passed to non-ballistic first actuator 47 delivering electrical energy to first, second, third, and fourth brushes 84-87. The electrical energy causes armature 80 to shift relative to stator 78 delivering the first actuation pressure at the first force profile into slip members 30.

Figure 5:
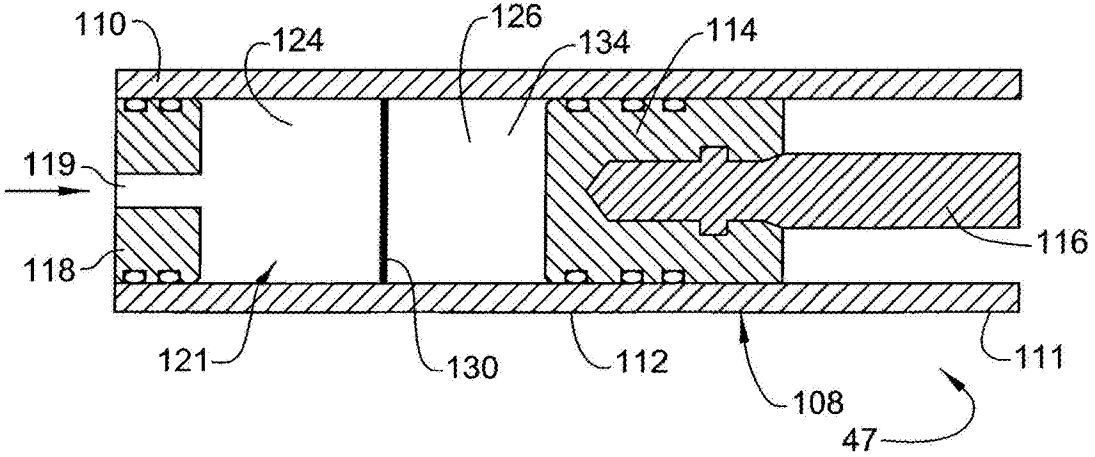
FIG. 5 depicts the non-ballistic first actuator of the non-ballistic force generating mechanism, in accordance with another aspect of an exemplary embodiment.

FIG. 5 depicts non-ballistic first actuator 47 in accordance with another aspect of an exemplary embodiment. Non-ballistic first actuator 47 includes a housing 108 having a first end 110, a second end 111 and an intermediate portion 112 extending therebetween. A piston 114 is arranged in housing 108. Piston 114 is operatively connected to a first actuator element 116 which extends outwardly of second end 111. A cap member 118 is arranged at first end 110. Cap member 118 may include a passage 119. A chamber 121 is defined between piston 114 and cap member 118. Chamber 121 may include a first chamber portion 124 and a second chamber portion 126 selectively separated by a selectively ruptureable barrier 130. Second chamber portion 126 may contain a non-ballistic reactive material 134 and first chamber portion 124 may contain an activation driver (not separately labeled) that may take the form of an activating fluid.

In accordance with an exemplary aspect, non-ballistic reactive material 134 may take the form of an active metal that reacts with a fluid, such as downhole fluid, to produce a gas that generates the first activation pressure. Active metals may include, but not be limited to, potassium (K), sodium (Na), and or IN-Tallic™ material produced by Baker Hughes, Inc. Other materials that may react with fluid, such as water may be employed. It is to be understood that the non-ballistic reactive material may be chosen from a group of materials that react with non-water based fluids to generate a desired pressure having the first force profile either by generating a gas or by expansion.

Figure 6:
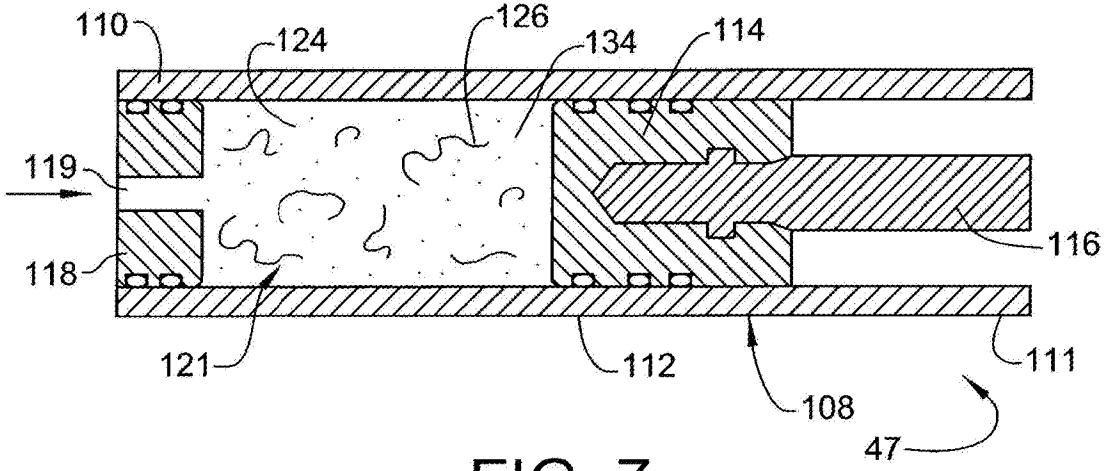
FIG. 6 depicts the non-ballistic first actuator of the non-ballistic force generating mechanism of FIG. 5 during an actuation event, in accordance with an aspect of an exemplary embodiment.

In accordance with an aspect of an exemplary embodiment, activating fluid may take the form of a downhole fluid selectively introduced into first chamber portion 124 via passage 119. Selectively ruptureable barrier 130 may be ruptured by downhole pressure or pressure developed by the activating fluid. The activating fluid interacts with non-ballistic reactive material 134 generating, for example, a gas 138 shown in FIG. 6, which shifts piston 114 toward second end 111 at the first activation pressure having the first activation profile.

Figure 7:
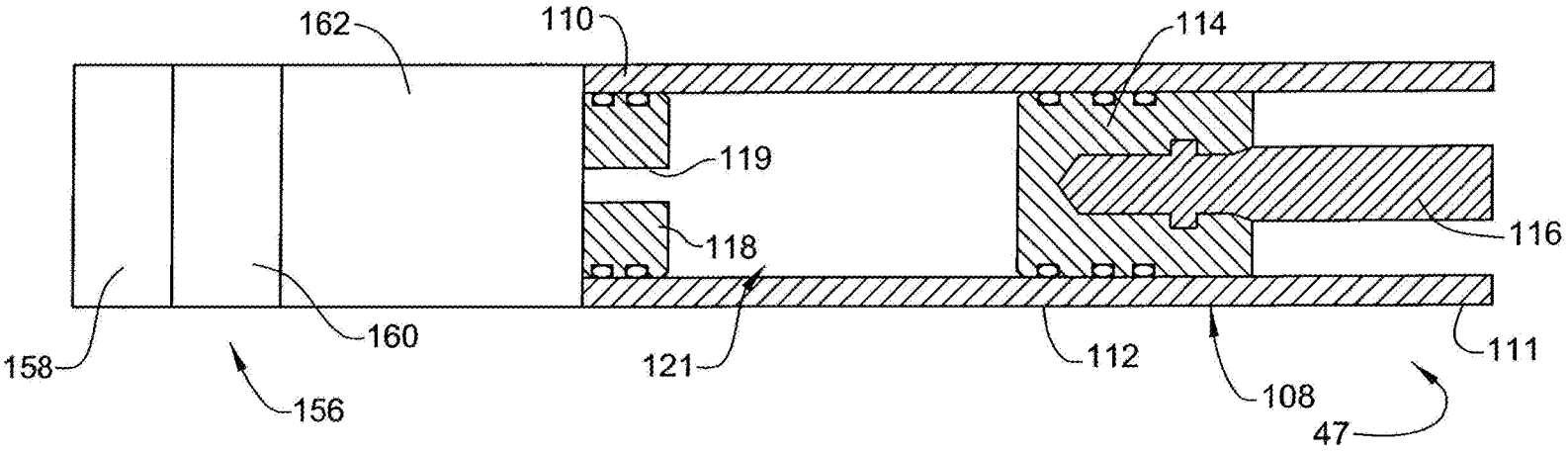
FIG. 7 depicts the non-ballistic first actuator of the non-ballistic force generating mechanism, in accordance with yet another aspect of an exemplary embodiment.

FIG. 7, wherein like reference numbers represent corresponding parts in the respective views, depicts a non-ballistic first actuator 47 including a pump assembly 156 for selectively delivering the activating fluid, which may be in the form of a pressurized fluid, into chamber 121. Pump assembly 156 may include a motor 158, a pump portion 160 and a reservoir portion 162. Reservoir portion 162 may store a fluid that, when acted upon by pump assembly 156, generates the first force profile. It is to be understood that pump assembly may deliver an activating fluid from reservoir portion 162 into a reactive material to generate the first force profile. As noted above, the particular type of activating fluid may vary and may depend upon the particular type of non-ballistic reactive material chosen to produce the first force profile.

Figure 8:
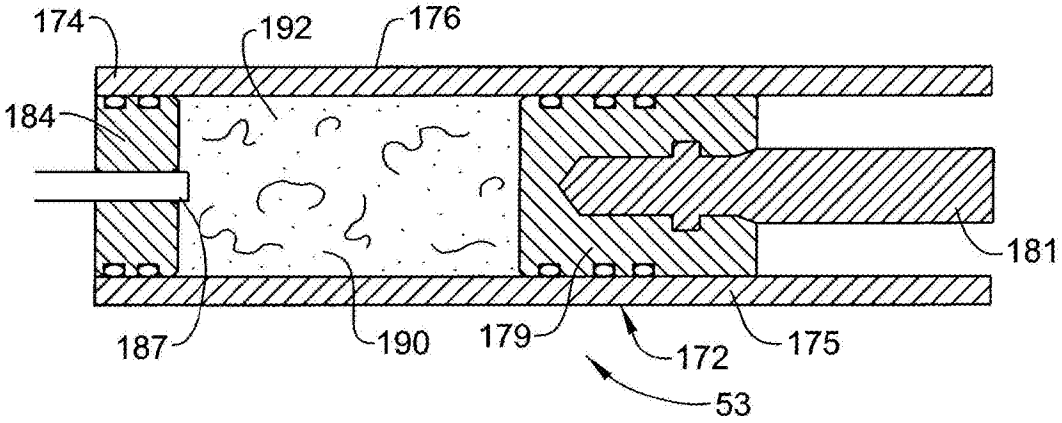
FIG. 8 depicts a second actuator of the non-ballistic force generating mechanism, in accordance with an aspect of an exemplary embodiment.

FIG. 8 depicts non-ballistic second actuator 53 in accordance with an aspect of an exemplary embodiment. Non-ballistic second actuator 53 includes a housing 172 having a first end portion 174, a second end portion 175 and an intermediate section 176 extending therebetween. A piston 179 is arranged in housing 172 and is operatively connected with a second actuator element 181 that extends outwardly through second end portion 175. A cap member 184 is arranged at first end portion 174. Cap member 184 may support an activator 187. A chamber 190 is defined between cap member 184 and piston 179.

In accordance with an aspect of an exemplary embodiment, chamber 190 may house a high density thermally responsive expandable material 192 that, when activated, establishes the second activation force having the second force profile. Unlike the first activation force, the second activation force comprises a high activating force with a short travel distance or stroke length (as compared to the first stroke length. Further, the second activation force is achieved without the use of ballistic material such as an accelerant. The second activation force provides a high energy actuation energy that drives, for example, slip members 30 outwardly to embed into the borehole or casing surface.

In accordance with an aspect of an exemplary embodiment, the high density thermally responsive expandable material may take the form of expandable graphite such as Exphite. When the thermally responsive expandable material is exposed to an electric current, electromagnetic radiation, or heat provided by, for example, activator 187, an intense exothermic reaction occurs, generating localized heat in fractions of a second, providing a thermal shock leading to rapid expansion. Given that heat is generated locally and quickly absorbed by the high density thermally responsive expandable material, detrimental effects on other portions of actuation tool 40 and other downhole components may be avoided.

In accordance with an aspect of an exemplary embodiment, the thermally responsive expandable material may be mixed with an activation or energizing material that degrades to generate local pressures which provide a driving force to expand the high density thermally responsive material. For example, expandable graphite may be mixed with various intercalate materials including acids, oxidants, halides, or the like. Examples of intercalate materials may further include sulfuric acid, nitric acid, chromic acid, boric acid, SO3, FeCL3, ZnCl2, and SbCl5. Upon heating, the intercalant material is converted from a liquid or solid state to a gas phase generating pressure which pushes adjacent carbon layers apart resulting in expanded graphite.

Figure 9:
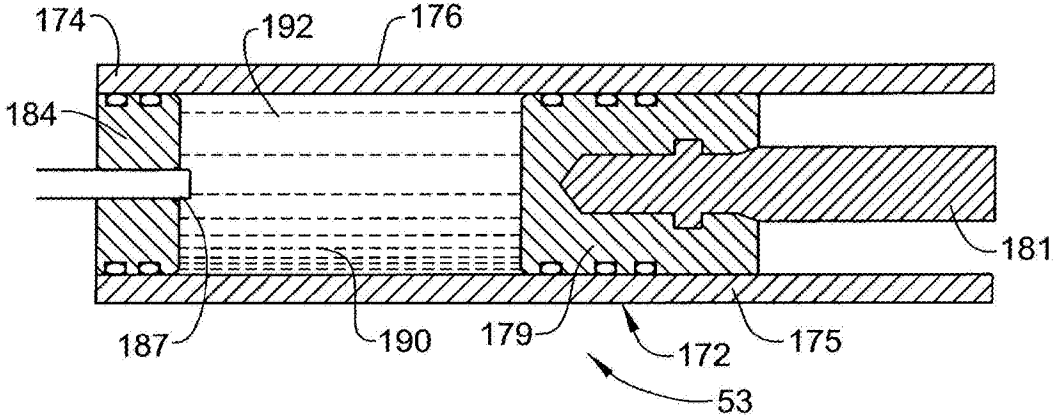
FIG. 9 depicts a second actuator of the non-ballistic force generating mechanism, in accordance with another aspect of an exemplary embodiment.

Examples of high density thermally responsive material may include material may include compounding expandable graphite with an activation material such as thermite, a mixture of Al and Ni, or a combination including at least one of the forgoing and compression molding the mixture at temperatures below 100° F. (37.77° C.). Other examples of high density thermally responsive material may include shape memory alloys, organic materials, and the use of super critical fluids such as shown in FIG. 9. It is to be understood that the term "supercritical fluid" describes any substance at a temperature and pressure above its critical point, where distinct liquid and gas phases do not exist. Examples of super critical fluids that may be employed in connection with exemplary embodiments include those depicted in the Table below.

| Substance | | Critical temperature (K) | Critical temperature (° C.) | Critical temperature (° F.) | Critical pressure (Mpa) | Critical pressure (atm) | Critical pressure (ksi) |
|---|---|---|---|---|---|---|---|
| Water | H2O | 647.1 | 374.1 | 705.4 | 22.1 | 217.8 | 3.21 |
| Alkanes | | | | | | | |
| Ethane | C2H6 | 305.3 | 32.3 | 90.1 | 4.87 | 48.1 | 0.71 |
| Propane | C3H8 | 369.8 | 96.8 | 206.2 | 4.25 | 41.9 | 0.62 |
| Butane | C4H10 | 425.1 | 152.1 | 305.8 | 3.8 | 37.5 | 0.55 |
| Pentane | C5H12 | 469.8 | 196.8 | 386.2 | 3.36 | 33.2 | 0.49 |
| Hexane | C6H14 | 507.6 | 234.6 | 454.3 | 3.02 | 29.8 | 0.44 |
| Alkenes | | | | | | | |
| Ethylene | C2H4 | 282.4 | 9.4 | 48.9 | 5.04 | 49.7 | 0.73 |
| Propylene | C3H6 | 364.9 | 91.9 | 197.4 | 4.6 | 45.4 | 0.67 |
| Others | | | | | | | |
| Cyclohexane | C6H12 | 279.8 | 6.8 | 44.2 | 4.07 | 40.2 | 0.59 |
| Bezene | C6H6 | 562 | 289 | 552.2 | 4.89 | 48.3 | 0.71 |
| Toluene | C7H8 | 591.79 | 318.79 | 605.8 | 4.11 | 40.6 | 0.60 |
| Methanol | CH3OH | 512.6 | 239.6 | 463.3 | 8.09 | 79.8 | 1.17 |
| Ethanol | C2H5OH | 513.9 | 240.9 | 465.6 | 6.14 | 60.6 | 0.89 |
| Propanol | C3H7OH | 536.9 | 263.9 | 507.0 | 5.2 | 51.3 | 0.75 |
| Ethylene glycol | C2H6O2 | 720 | 447 | 836.6 | 8.2 | 80.9 | 1.19 |
| Acetone | C3H6O | 508.1 | 235.1 | 455.2 | 4.7 | 46.4 | 0.68 |

In operation, non-ballistic first actuator 47 is activated to shift slip members 30 into contact with a borehole or well casing surface. At this point, BLR 56 is unlocked such that second module 52 may transition with the first activation force. After the first activation force has been applied, BLR 56 is locked preventing movement of second module 52 and non-ballistic second actuator 53 is initiated to create the second activation force driving slip members 30 into the borehole or well casing surface. As indicated above, the first activation force comprises a force delivered through a first stroke length while the second activation force comprises a rapidly increasing high energy force delivered through a second stroke length. In accordance with an aspect of an exemplary embodiment, the second force may be multiple times greater than the first force and the second stroke length may be less than half of the first stroke length. At this point, it is to be understood that exemplary embodiments describe a system of actuating a downhole devices without an accelerant. In this manner, once activated and retrieved, there would be no need to handle high pressure components typically associated with ballistically activated tools. It is also to be understood that while described in terms of activating a slip assembly, exemplary embodiments may be employed in a wide range of downhole actuation operations including setting a packer, operating valves, shifting mandrels and the like. It is to be further understood that various mechanisms may be employed to selectively activate either of the non-ballistic first actuator or the non-ballistic second actuator. It should also be understood that hydrostatic pressure may be employed to generate either of the first or second force profiles. Additionally, the high density thermally responsive material may take the form of a polymer having a linear coefficient of thermal expansion of between about 50×10^−6K−1 to about 100×10^−6K−1 that selectively generates the second force profile.

Further included in this disclosure are the following specific embodiments, which do not necessarily limit the claims.

Embodiment 1

A non-ballistic force generating mechanism comprising: a non-ballistic first actuator operable to output a first force profile defining a first pressure for a first stroke length; and a non-ballistic second actuator operable to output a second force profile following the first force profile, the second force profile defining a second pressure that is substantially greater than the first pressure for a second stroke length that is less than the first stroke length.

Embodiment 2

The non-ballistic force generating mechanism according to embodiment 1, wherein the non-ballistic first actuator comprises an electromagnetic launcher having a stator and an armature moveable relative to the stator, the armature selectively generates the first force profile.

Embodiment 3

The non-ballistic force generating mechanism according to embodiment 1, wherein the non-ballistic first actuator includes a non-ballistic reactive material that selectively generates the first force profile.

Embodiment 4

The non-ballistic force generating mechanism according to embodiment 3, wherein the non-ballistic first actuator includes a chamber including a first portion housing the non-ballistic reactive material and a second portion housing an activation driver that is selectively introduced into the first portion to generate the first force profile.

Embodiment 5

The non-ballistic force generating mechanism according to embodiment 3, wherein the non-ballistic reactive material comprises at least one of an active metal and In-Tallic.

Embodiment 6

The non-ballistic force generating mechanism according to embodiment 1, wherein the non-ballistic second actuator includes a thermally responsive expandable material that selectively generates the second force profile.

Embodiment 7

The non-ballistic force generating mechanism according to embodiment 6, wherein the thermally responsive expandable material comprises expandable graphite.

Embodiment 8

The non-ballistic force generating mechanism according to embodiment 7, wherein the expandable graphite includes an activation material.

Embodiment 9

The non-ballistic force generating mechanism according to embodiment 6, wherein the thermally responsive expandable material comprises a supercritical fluid.

Embodiment 10

The non-ballistic force generating mechanism according to embodiment 6, wherein the non-ballistic second actuator includes a polymer having linear coefficient of thermal expansion of between about 50×10^−6K−1 to about 100×10^−6K−1 that selectively generates the second force profile.

Embodiment 11

The non-ballistic force generating mechanism according to embodiment 1, wherein at least one of the non-ballistic first actuator and the non-ballistic second actuator are responsive to hydrostatic pressure to generate corresponding ones of the first force profile and the second force profile.

Embodiment 12

The non-ballistic force generating mechanism according to embodiment 1, further comprising: a pump portion operable to generate a desired pressure to output at least one of the first force profile and the second force profile.

Embodiment 13

A resource exploration and recovery system comprising: a surface system; a downhole system including a plurality of tubulars and at least one actuatable device; and an actuation tool having a non-ballistic force generating mechanism extending through one or more of the plurality of tubulars toward the at least one actuatable device, the non-ballistic force generating mechanism comprising: a non-ballistic first actuator operable to output a first force profile to the at least one actuatable device, the first force profile defining a first pressure for a first stroke length; and a non-ballistic second actuator operable to output a second force profile to the at least one actuatable device following the first force profile, the second force profile defining a second pressure that is substantially greater than the first pressure for a second stroke length that is less than the first stroke length.

Embodiment 14

The resource exploration and recovery system according to embodiment 13, wherein the non-ballistic first actuator comprises an electromagnetic launcher having a stator and an armature moveable relative to the stator, the armature selectively generates the first force profile.

Embodiment 15

The resource exploration and recovery system according to embodiment 13, wherein the non-ballistic first actuator includes a non-ballistic reactive material that selectively generates the first force profile.

Embodiment 16

The resource exploration and recovery system according to embodiment 15, wherein the non-ballistic first actuator includes a chamber including a first portion housing the non-ballistic reactive material and a second portion housing a activation driver that is selectively introduced into the first portion to generate the first force profile.

Embodiment 17

The resource exploration and recovery system according to embodiment 15, wherein the non-ballistic reactive material comprises at least one of an active metal and In-Tallic.

Embodiment 18

The resource exploration and recovery system according to embodiment 13, wherein the non-ballistic second actuator includes a thermally responsive expandable material that selectively generates the second force profile.

Embodiment 19

The resource exploration and recovery system according to embodiment 18, wherein the thermally responsive expandable material comprises expandable graphite.

Embodiment 20

The resource exploration and recovery system according to embodiment 18, wherein the thermally responsive expandable material comprises a supercritical fluid.

Embodiment 21

A method of actuating a downhole device comprising: activating a non-ballistic first actuator to deliver a first activation pressure having a first force defined by a first force profile to the downhole device; and activating a non-ballistic second actuator to deliver a second activation pressure having a second force profile including a second force, that is substantially greater than the first force, to the downhole device.

Embodiment 22

The method of embodiment 21, wherein activating the non-ballistic first actuator includes delivering electrical energy to an electromagnetic launcher that delivers the first activation pressure to the downhole device.

Embodiment 23

The method of embodiment 21, wherein activating the non-ballistic first actuator includes energizing a non-ballistic reactive material that selectively generates the first force profile.

Embodiment 24

The method of embodiment 23, wherein energizing the non-ballistic reactive material includes introducing a liquid to the non-ballistic reactive material.

Embodiment 25

The method of embodiment 21, wherein activating the non-ballistic second actuator includes energizing a thermally responsive expandable material that selectively generates the second force profile.

Embodiment 26

The method of embodiment 21, wherein activating the non-ballistic second actuator includes energizing a supercritical fluid.

Embodiment 27

The method of embodiment 21, wherein activating the non-ballistic second actuator includes exposing a chamber to hydrostatic pressure.

Embodiment 28

The method of embodiment 21, wherein activating the non-ballistic first actuator includes operating a pump to generate a pressurized fluid to deliver the first activation pressure.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A non-ballistic force generating mechanism for a downhole device comprising: a non-ballistic first actuator operable to output a first force profile defining a first pressure for a first stroke length, the non-ballistic first actuator comprising an electromagnetic launcher having a stator and an armature moveable relative to the stator, the armature selectively generates the first force profile; and a non-ballistic second actuator operable to output a second force profile following the first force profile, the second force profile defining a second pressure that is substantially greater than the first pressure for a second stroke length that is less than the first stroke length.

2. The non-ballistic force generating mechanism according to claim 1, wherein the non-ballistic second actuator includes a thermally responsive expandable material that selectively generates the second force profile.

3. The non-ballistic force generating mechanism according to claim 2, wherein the thermally responsive expandable material comprises expandable graphite.

4. The non-ballistic force generating mechanism according to claim 3, wherein the expandable graphite includes an activation material.

5. The non-ballistic force generating mechanism according to claim 2, wherein the thermally responsive expandable material comprises a supercritical fluid.

6. The non-ballistic force generating mechanism according to claim 2, wherein the non-ballistic second actuator includes a polymer having linear coefficient of thermal expansion of between about 50×10^-6K-1 to about 100×10^-6K-1 that selectively generates the second force profile.

7. The non-ballistic force generating mechanism according to claim 1, wherein at least one of the non-ballistic first actuator and the non-ballistic second actuator are responsive to hydrostatic pressure to generate corresponding ones of the first force profile and the second force profile.

8. The non-ballistic force generating mechanism according to claim 1, further comprising: a pump portion operable to generate a desired pressure to output at least one of the first force profile and the second force profile.

9. A non-ballistic force generating mechanism for a downhole device comprising: a non-ballistic first actuator operable to output a first force profile defining a first pressure for a first stroke length, the non-ballistic first actuator including a non-ballistic reactive material comprising at least one of an active metal and a decomposable metal that selectively generates the first force profile; and a non-ballistic second actuator operable to output a second force profile following the first force profile, the second force profile defining a second pressure that is substantially greater than the first pressure for a second stroke length that is less than the first stroke length the non-ballistic first actuator includes a non-ballistic reactive material that selectively generates the first force profile.

10. The non-ballistic force generating mechanism according to claim 9, wherein the non-ballistic first actuator includes a chamber including a first portion housing the non-ballistic reactive material and a second portion housing an activation driver that is selectively introduced into the first portion to generate the first force profile.

11. A resource exploration and recovery system comprising:

a surface system;

a downhole system including a plurality of tubulars and at least one actuatable device; and an actuation tool having a non-ballistic force generating mechanism extending through one or more of the plurality of tubulars toward the at least one actuatable device, the non-ballistic force generating mechanism comprising:

a non-ballistic first actuator operable to output a first force profile to the at least one actuatable device, the first force profile defining a first pressure for a first stroke length, the non-ballistic first actuator comprising an electromagnetic launcher having a stator and an armature moveable relative to the stator, the armature selectively generates the first force profile; and a non-ballistic second actuator operable to output a second force profile to the at least one actuatable device following the first force profile, the second force profile defining a second pressure that is substantially greater than the first pressure for a second stroke length that is less than the first stroke length.

12. The resource exploration and recovery system according to claim 11, wherein the non-ballistic second actuator includes a thermally responsive expandable material that selectively generates the second force profile.

13. The resource exploration and recovery system according to claim 12, wherein the thermally responsive expandable material comprises expandable graphite.

14. The resource exploration and recovery system according to claim 12, wherein the thermally responsive expandable material comprises a supercritical fluid.

15. A resource exploration and recovery system comprising:

a surface system;

a downhole system including a plurality of tubulars and at least one actuatable device; and an actuation tool having a non-ballistic force generating mechanism extending through one or more of the plurality of tubulars toward the at least one actuatable device, the non-ballistic force generating mechanism comprising:

a non-ballistic first actuator operable to output a first force profile to the at least one actuatable device, the first force profile defining a first pressure for a first stroke length, the non-ballistic first actuator includes a non-ballistic reactive material comprising at least one of an active metal and a decomposable metal that selectively generates the first force profile; and a non-ballistic second actuator operable to output a second force profile to the at least one actuatable device following the first force profile, the second force profile defining a second pressure that is substantially greater than the first pressure for a second stroke length that is less than the first stroke length.

16. The resource exploration and recovery system according to claim 15, wherein the non-ballistic first actuator includes a chamber including a first portion housing the non-ballistic reactive material and a second portion housing a activation driver that is selectively introduced into the first portion to generate the first force profile.

17. A method of actuating a downhole device comprising:

activating a non-ballistic first actuator to deliver a first activation pressure having a first force defined by a first force profile to the downhole device by delivering electrical energy to an electromagnetic launcher that delivers the first activation pressure to the downhole device; and activating a non-ballistic second actuator to deliver a second activation pressure having a second force profile including a second force, that is substantially greater than the first force, to the downhole device.

18. The method of claim 17, wherein activating the non-ballistic second actuator includes energizing a thermally responsive expandable material that selectively generates the second force profile.

19. The method of claim 17, wherein activating the non-ballistic second actuator includes energizing a supercritical fluid.

20. The method of claim 17, wherein activating the non-ballistic second actuator includes exposing a chamber to hydrostatic pressure.

21. The method of claim 17, wherein activating the non-ballistic first actuator includes operating a pump to generate a pressurized fluid to deliver the first activation pressure.

22. A method of actuating a downhole device comprising:

activating a non-ballistic first actuator to deliver a first activation pressure having a first force defined by a first force profile to the downhole device by energizing a non-ballistic reactive material comprising at least one of an active metal and a decomposable metal that selectively generates the first force profile; and activating a non-ballistic second actuator to deliver a second activation pressure having a second force profile including a second force, that is substantially greater than the first force, to the downhole device.

23. The method of claim 22, wherein energizing the non-ballistic reactive material includes introducing a liquid to the non-ballistic reactive material.

* * * * *